United States Patent [19]

Tiberg et al.

[11] 3,961,779

[45] June 8, 1976

[54] APPARATUS AND METHOD FOR REFINING A METAL MELT

[75] Inventors: Magnus Gustav Georg Tiberg, Hallefors; Jan B:Son Uggla, Vasteras, both of Sweden

[73] Assignee: Allmanna Svenska Elektriska Aktiebolaget, Vasteras, Sweden

[22] Filed: Nov. 14, 1974

[21] Appl. No.: 523,886

[30] Foreign Application Priority Data

Nov. 14, 1973 Sweden ..... 7315403

[52] U.S. Cl. ..... 266/225

[51] Int. Cl.[2] ..... C21C 7/00

[58] Field of Search ..... 266/34 A, 34 L, 34 LM, 266/34 T, 34 V, 35, 41, 39, 36 P; 75/49, 59, 60

[56] References Cited

UNITED STATES PATENTS 2,855,293 10/1958 Savard et al. ..... 75/60

*Primary Examiner*—Gerald A. Dost

*Attorney, Agent, or Firm*—Kenyon & Kenyon Reilly Carr & Chapin

[57] ABSTRACT

An unfinished steel melt is tapped from its primary melter into an upright ladle having one or more nozzles in its side above the level of the melt. The ladle is then tilted in the direction of the nozzle or nozzles so that it covers them, oxidizing gases, slag formers, alloying elements, etc., then being injected into the melt below its surface as a refining and finishing operation. The ladle has an inductive stirrer that tilts with the ladle and may be used when the ladle is upright or tilted. By tilting the ladle the top surface of the melt is increased in area with a consequent increase in the area of contact between the melt and the slag which, together with the fact that the refining and finishing materials are injected directly into the melt, while the melt may be inductively stirred at the same time, provides for rapid and thorough refining and, if desired, alloying. After refining and finishing, the melt is cast in the molds. Only the single ladle is required to receive the melt from the primary melter, to refine and finish the melt, and to transport the melt to the casting location.

7 Claims, 2 Drawing Figures

APPARATUS AND METHOD FOR REFINING A METAL MELT

BACKGROUND OF THE INVENTION

In the production of steel, for example, to avoid tying-up a primary melter, such as an electric furnace, an unfinished melt can be tapped from that melter into a ladle, carried by the ladle to a converting vessel, transferred from the ladle into this vessel where refining and finishing materials are injected directly into the melt to obtain rapid reactions and possibly alloying, transferred from this converting vessel into a ladle and carried by this ladle to a casting location where the finished melt is cast. This frees the primary melter for further use, more promptly than when that melter is used for finishing and alloying after producing the unfinished melt, but it involves a number of separate operations, which is obviously objectionable.

In the converter vessel, oxygen, possibly with Argon for cooling, can be injected directly into the melt to burn out carbon quickly with incidental reheating. Pulverized slag formers can be injected directly into the melt to obtain rapid reactions. It is also possible to inject pulverized alloying material into the melt to obtain rapid alloying.

However, the converter vessel must be a specialized piece of equipment, and because the melt must be carried in a ladle from the primary melter where the melt was formed, to the converter vessel, and in a ladle from the converter vessel to the casting location, the quality of the finished melt that is cast, is not as good as might be expected from the use of this practice.

In the ASEA-SKF process, which is the commercialized form of the invention disclosed by the British patent specification No. 1,112,876, published May 8, 1968, a single ladle is used for the refining and finishing operations. The unfinished melt is tapped from the primary melter into this ladle to free that melter for reuse, the ladle is moved into the field of an electric induction melt stirrer, the ladle being of non-magnetic construction, and the melt is stirred while possibly being subjected to evacuation by using an evacuating cover closing the top of the ladle, after which this cover is removed and replaced by a roof having electric arc heating electrodes so the temperature of the melt can be adjusted while alloying additions are dropped on the melt, the same ladle then being carried to the casting location. Sometimes, after alloying, an evacuating cover provided with an oxygen lance inserted in the melt through the melt's top surface, is used for vacuum-decarburizing the alloy additions.

Although this ASEA-SKF equipment permits a single ladle to be used throughout the refining and finishing operations, with the finished melt cast from this ladle into molds, it does not provide for the direct injection into the melt of gases, slag formers, deoxidizing agents, alloying material, etc., excepting for the lance possibly used during the vacuum-decarburizing of the alloy additions and which must be inserted through the top surface of the melt.

In the case of the refining converter of the first-described practice, it is usual to have injection nozzles in the bottom of the converter vessel and through which the gases or other materials can be injected into the melt when the melt is in the vessel, but this prohibits use of the refining converter otherwise than for the injection step.

SUMMARY OF THE INVENTION

According to the present invention, the unfinished melt to be refined and finished is tapped from the primary melter into an upright but tiltable ladle, which may be cylindrical, and which has a side wall extending to a rim substantially above the top of this melt when the ladle is upright, providing a side wall portion uncontacted by the melt. This ladle is of non-magnetic construction and is provided with an electric induction stirrer for the melt, permitting the melt to be stirred inductively as in the case of the ASEA-SKF equipment. The ladle, by using an evacuating cover, also can be used for degassing at that time.

As a prime feature, this ladle is provided with at least one nozzle, and there may be a multiplicity of nozzles, pointing downwardly through the ladle's side wall portion which is free from the melt. Also, this side wall is the one that is downward when the ladle is tilted, and means are provided for tilting the ladle so that the nozzle then becomes submerged in the melt. The nozzle has means for injecting a gas through it to protect it at that time, and the nozzle is provided with a reciprocative lance which can be pushed forwardly and downwardly through the nozzle, to bring its end substantially centrally within the melt in the tilted ladle.

In addition, the inductive stirrer tilts with the ladle so that the inductive stirring may be continued at all times. By tilting the ladle the top surface of the melt is substantially increased in surface area, providing an increased area of contact between the melt and slag floating on the melt. The ladle is provided with a gas-tight cover having an outlet.

With the lance in use, oxygen may be injected into the melt for decarburization with incidental reheating, while an inert gas is passed through the nozzle around the lance, for cooling and possibly other purposes. In addition to oxygen, pulverized materials can be directly injected into the melt. For example, after decarborization when the oxygen injection is terminated, it may be followed by the injection of pulverized slag formers, deoxidizing agents, alloying materials, etc.

After complete refining and finishing, the ladle is returned to its upright position, freeing the nozzle or nozzles from the melt and permitting stoppage of all gas flow through the nozzle. At this time, it is possible to apply a cover having electric arc heating electrodes, as in the ASEA-SKF process, to adjust the melt temperature as desired. The inductive stirrer tilts back with the ladle and may be used at this time.

Afterwards, the same ladle is used for casting of the melt. The one single ladle is used throughout.

BRIEF DESCRIPTION OF THE DRAWINGS

An example of the invention is schematically illustrated by the accompanying drawings, in which.

DETAILED DESCRIPTION OF THE INVENTION

Figure 1:
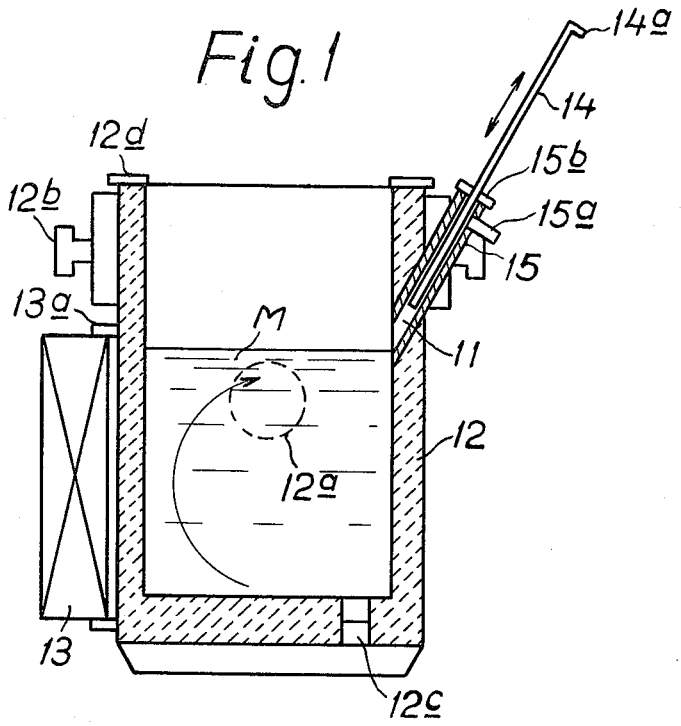
FIG. 1 shows the new apparatus in vertical section when the ladle is upright and contains the just-tapped melt from the primary melter.

Having reference to FIG. 1, for simplicity of description, only a single nozzle 11 is shown pointing downwardly through the side wall of the ladle 12 which is made of non-magnetic material and has the electric induction stirrer coil 13 which is positioned on what will become the upright side of the ladle when the ladle is tilted. The nozzle 11 is positioned above the level of the top surface of the melt which has been tapped into the ladle from the primary melter. Otherwise than for its location, the nozzle 11 may be conventional, it having the reciprocative lance 14 provided with an inlet 14*a*, and which slides concentrically within the nozzle tube 15 having an inlet 15*a* and a gas-tight seal 15*b* in which the lance 14 slides. The outside diameter of the lance is smaller than the inside diameter of the nozzle 11 and nozzle tube 15.

The inductive stirrer coil 13 is shown connected with the ladle as at 13*a* so that this coil tilts with the ladle but the coil could be separately mounted by an appropriate tilting system. This is a low-frequency, multi-phase electro-magnetic stirrer, and although it is shown as being of the straight type, it could be of the type which encircles the ladle. The ladle is shown as provided with trunions 12*a* and as having lifting ears 12*b*. As shown, the side wall of the ladle which is upward during tilting, is of substantially reduced thickness as compared to the balance of the ladle, as for example, being about one-half as thick.

Although only one nozzle and injector lance are shown, there may be a number of them positioned through the side wall of the ladle 12. They should all be at a level above the top level or surface of the melt when the ladle is upright and be submerged in the melt when the ladle is tilted. The ladle is provided with a removable gas-tight cover 16 having an outlet 17 for gases or for evacuation of the ladle. As shown, the ladle is provided with the usual plugged teeming hole 12*c* which, for casting, is unplugged and provided with a suitable valve for controlling the casting.

Although the schematic drawings show only the refractory linings, it is to be understood that the ladle and its cover may be encased by metal, providing the casing of the ladle is non-magnetic.

According to this invention, the ladle 12 is carried either by a trolley (not shown) or crane-carried via its ears 12*b* to the primary melter where the melt is tapped in. The side wall of the ladle is proportioned relative to the melt, or vice versa, so that the side wall extends to its rim 12*d* to provide the portion extending above the top surface of the melt, when the ladle is upright as shown in FIG. 1.

Normally the ladle would then be carried to a location where the stirrer 13 can be connected to its side wall portion, if the stirrer is not permanently fixed to the ladle, while connections are made to the inlets 14*a* and 15*a*. This permits inductive stirring to be practiced, this being possible whether or not the ladle is upright or tilted. During this time, the downwardly declining nozzle or nozzles 11 are above the top level of the melt so that it is unnecessary to maintain a gas flow. It is to be assumed that the ladle's trunions 12*a* may be placed in suitable bearings.

Figure 2:
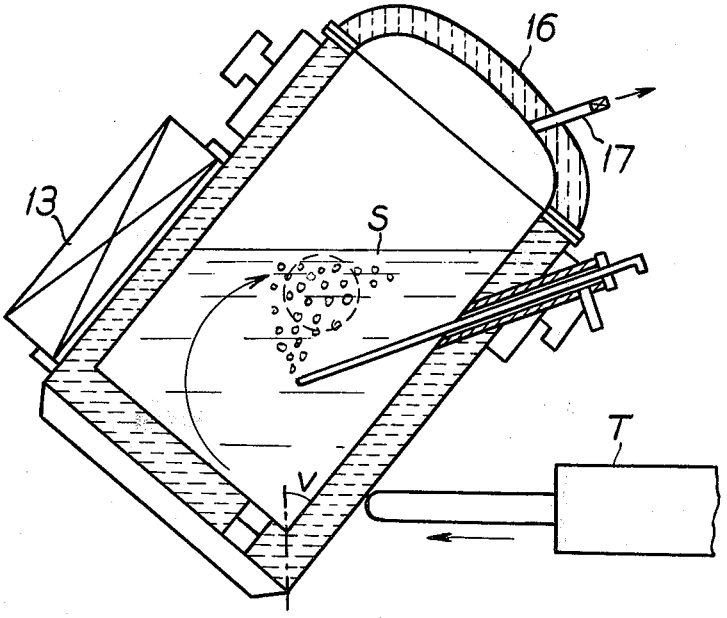
FIG. 2 is the same as FIG. 1 but shows the injection action with the ladle in its tilted position and with the cover applied.

Next, the cover 16 is applied so that the ladle is sealed gas-tightly, and the ladle is tilted as by means of a thruster T to an angle of, for example 40°, and at the same time a suitable gas, such as Argon, is blown through the nozzle 11 by way of the nozzle tube's inlet 15*a*. This protects the nozzle which is now immersed in the melt. The blowing in of this gas stirs the melt to aid the inductive stirring effected by the stirrer 13 which tilts with the ladle. Insertion of the lance 14 moves its inner end from behind the orifice of the nozzle 11 to a forward position substantially centrally within the melt, permitting oxygen to be injected directly into the melt with the resulting gases, caused by decarburizing for example, exhausting through the cover's outlet 17. Pulverized slag formers can then be blown in with the forming slag S floating on the melt. Because of the tilted position, the surface area at the top of the melt is substantially increased providing a relatively large area of contact between the melt and the slag. At the same time the inductive stirring can be continued, as indicated by the arrow in both figures. The thinner or upper side of the ladle is in the less erosive zone, while the balance of the ladle having the thicker wall is better able to withstand the erosion that is incidental. As previously indicated, the tilting angularity as indicated in FIG. 2 at V, may be in the area of 40°. All of the practices that can be performed by any other direct injection process, can be effected with this new apparatus, but without requiring transferring of the melt from one container to another a number of times.

Final decarburization can be effected by the use of oxygen injected through the lance 14. Impurities which were left in by the primary melter, can be reduced as required by the injection of appropriate slag formers. The injection of deoxidizing agents is entirely practical. All of the reactions involved proceed rapidly and thoroughly.

Afterwards, the ladle is returned to its upright position, and if desired, it can be degassed by evacuation through the use of the cover 16 and 17. Then, if necessary or desired, the cover 16 may be replaced by a cover having the electric arc heating electrode (not shown) as used in the ASEA-SKF practice. This permits final temperature adjustment.

Finally, with the cover 16 removed, the same ladle that has been in use throughout may be transported, possibly after disconnection and removal of the stirrer 13, to the casting location, where its teeming hole 12*c* is unplugged to permit normal casting, normally into suitable molds providing shapes desired.

The depth of the ladle 12 should be sufficient to permit the ladle to be tilted to about the 40° angularity without the melt level reaching the rim of the ladle. The angularity of the nozzle 11 and its tube 15 and the position of the nozzle, and all others if used, should be such as to be above the level of the melt M when the ladle is upright as shown in FIG. 1. At the same time, the nozzle position and downward angularity and the length of the lance 14 should be such that when the ladle is tilted, as shown in FIG. 2, the inner end of the lance can be located centrally within the melt and, as previously indicated, there may be a number of the nozzle-and-lance arrangements used.

It can be seen that this invention permits the advantages of the direct injection refining practice to be provided with the advantages of the ASEA-SKF technique. The melt can be teemed from the primary melter into the single ladle that is then used throughout and up to and including the casting. While upright, no gas needs to be blown through the nozzle or nozzles and the melt tapped from the primary melter can be inductively stirred or otherwise processed. When tilted, the inductive stirring can continue and the direct injection into the melt started. All of the direct injection practices can be used. When the vessel is returned to its upright position, the blowing of gas can be stopped because the nozzle or nozzles are above the melt level.

All of the ASEA-SKF procedures can then be practiced.

What is claimed is:

1. A metal melt refining apparatus comprising a tiltable ladle for containing the melt, said ladle having a side wall upwardly extending to a rim substantially above the top surface of said melt when the ladle is upright, means for tilting said ladle to a degree substantially increasing the area of said surface without the surface extending above said rim, and at least one downwardly pointing nozzle positioned through said side wall and opening therethrough at a position above the melt's said top surface when said ladle is upright and below this top surface when the ladle is tilted by said means.

2. The apparatus of claim 1 having a lance inserted through said nozzle, said lance having an inner end and being reciprocative at least to a degree withdrawing the lance's said end within said nozzle and advancing the lance so its said end is projected beyond the nozzle and into said melt when said ladle is tilted.

3. The apparatus of claim 1 having means tilting with said ladle for inductively stirring said melt in the ladle.

4. The apparatus of claim 1 in which a portion of said side wall which is upward when said ladle is tilted, has a smaller wall thickness than the portion of said side wall which is downward when the ladle is tilted.

5. The apparatus of claim 4 having at least one inductive melt-stirring coil positioned on the outside of said ladle and tilting with the ladle.

6. The apparatus of claim 5 having a lance inserted through said nozzle, an annular space being formed between said lance and nozzle, said lance having an inner end and being reciprocative at least to a degree withdrawing the lance's said end within said nozzle and advancing the lance so its said end is projected beyond the nozzle and into said melt when the ladle is tilted.

7. The apparatus of claim 6 having means for injecting a gas through said nozzle, and means for supplying said lance with melt-finishing material for injection directly into said melt.

* * * * *